US006254930B1

(12) United States Patent
Kreiselmaier

(10) Patent No.: US 6,254,930 B1
(45) Date of Patent: Jul. 3, 2001

(54) COATING TUBE PLATES AND COOLANT TUBE

(76) Inventor: Richard Kreiselmaier, Von-Braun-Strasse 23, 46244, Bottrop (DE)

( * ) Notice: Subject to any disclaimer, the term of this patent is extended or adjusted under 35 U.S.C. 154(b) by 0 days.

(21) Appl. No.: 09/102,047

(22) Filed: Jun. 22, 1998

Related U.S. Application Data

(63) Continuation-in-part of application No. 08/330,629, filed on Oct. 28, 1994, now Pat. No. 5,820,931.

(30) Foreign Application Priority Data

Apr. 22, 1994 (EP) ..... 94106304

(51) Int. Cl.[7] ..... B05D 7/22

(52) U.S. Cl. ..... 427/239; 427/230; 427/292; 427/388.1; 427/435; 165/110

(58) Field of Search ..... 427/230, 239, 427/292, 385.5, 388.1, 430.1, 435, 110

(56) References Cited

U.S. PATENT DOCUMENTS

| | | | |
|---|---|---|---|
| 3,689,311 | 9/1972 | Loeffler et al. | 427/292 |
| 4,795,662 | 1/1989 | Kreiselmaier | 427/292 |

FOREIGN PATENT DOCUMENTS

| | | |
|---|---|---|
| 1939665 | 2/1971 | (DE) . |
| A2515007 | 10/1976 | (DE) . |
| 7702562 U | 1/1977 | (DE) . |
| A0236388 | 9/1987 | (EP) . |
| 1175157 | 12/1969 | (GB) . |
| WO87/01437 | 3/1987 | (WO) . |

*Primary Examiner*—Shrive Beck
*Assistant Examiner*—Jennifer Calcagni
(74) *Attorney, Agent, or Firm*—Hunton & Williams

(57) ABSTRACT

Coating for the tube sheets and heat exchanger coolant tubes extending from them, especially steam condensers, based on hardening plastic mixtures, obtainable by cleaning the surfaces provided for coating using an abrasive; closing the tube inlets and outlets (or tube inlets only) with removable plugs; applying at least one layer of a hardening plastic coating on the tube sheet; allowing the coating to harden so that additional mechanical processing can ensue, and processing the surface; removing the plugs from the tube inlets and outlets (or tube inlets only) as well as applying at least one layer of a hardening plastic coating at least in the inlet area of the coolant tube, and allowing it to harden, coating of the coolant tubes by timed applications being done reactively to the tube sheet coating and the coolant tube coating exhibiting in comparison to the tube sheet coating a greater elasticity having an elongation at tear at least 2% greater in accordance with ASTM D522 with respect to the elongation at tear of the tube sheet coating, and process for coating tube sheets and coolant tubes extending from them.

13 Claims, 2 Drawing Sheets

COATING TUBE PLATES AND COOLANT TUBE

CROSS-REFERENCE TO RELATED APPLICATION

This is a continuation-in-part application of application Ser. No. 08/330,629, filed Oct. 28, 1994 now U.S. Pat. No. 5,820,931.

BACKGROUND OF THE INVENTION

1. Field of the Invention

The invention relates to a coating for tube sheets (also referred to herein as "tubesheets" or "tube beds") and heat exchanger coolant tubes extending from them, especially steam condensers, based on hardening plastic mixtures that can be obtained by cleaning the surfaces provided for coating using an abrasive; closing the tube inlets and outlets with removable plugs; applying at least one layer of a hardening plastic coating or mixture on the tube sheet; allowing the coating to harden so that additional mechanical processing can ensue, and processing the surface; removing the plugs from the tube inlets and outlets, as well as applying at least one layer of a hardening plastic coating at least in the inlet area of the coolant tube, and allowing it to harden, as well as a process for coating the tube sheet and heat exchanger coolant tubes extending from these. In an alternative embodiment only the tube inlets are closed with removable plugs, after the surfaces are cleaned with an abrasive, and the plugs are removed only from the tube inlets after the surface is processed.

2. Summary of the Related Art

How to provide tube sheets having heat exchangers, as they are for example employed in facilities for production of electrical energy, with a coat of plastic to counteract the effects of corrosion is known. Tube sheets and the coolant tubes extending from them are subject to a variety of external influences, especially mechanical, chemical, and elector-magnetic stresses. Mechanical stresses occur as a result of solid particles carried along by the coolant, sand, for example. In addition, enlargements in the roll in section, an area of the tube of the coolant tubes on the tube sheet occur as a result of the difference in temperature between the coolant and the steam to be condensed, which can exceed 100° C. Chemical stresses result from the nature of the coolant, for example, from its loading with salts or acid substances. In particular, remark should be made in this regard about the known corrosive effects of sea water or heavily-loaded river water employed for coolant purposes. The electro-chemical or galvanic corrosion that should be mentioned is that which occurs as a result of development of galvanic elements on metallic border surfaces, especially at the transitions from the tube sheets to coolant tube, and which is strongly promoted by electrically conductive liquids like sea water. In addition, there are limitations on the functionality of the tube sheet as a result of deposits of undesirable materials, formation of algae, etc., on its surface, which is particularly promoted by surface roughness resulting from the effects of corrosion. This has as its result that the effects of corrosion and deposits accelerate with the age of the tube sheet because they increasingly form new locations for corrosion and deposits to take hold.

From very early on, therefore, steps have been taken to provide tube sheets with a coating of plastic material that reduces corrosion. In particular, thick coats of epoxy resin were used for this purpose, these being adapted to the tubing inlets and outlets using certain techniques, for example, by using formed plugs during application. In this way coating of the tube sheets can initially be adapted seamlessly at the tubing inlets and outlets, interior coating of the mostly non-corrosive materials remaining at the ends of the tubes or in the area of the coating generally being dispensed with. But even in such solutions, coolant water could penetrate over time through microcracks and therefore could certainly not prevent development of galvanic elements; this having as its result an increasing incidence of corrosion after formation of the first crack. Even including the coolant tubes in the coated surface, at least in the area of its inlet and outlet, achieved only limited improvements, since the prevailing extreme thermal and mechanical stresses in this area lead to formation of hair-cracks in exactly the sensitive area that transitions from tube sheet to coolant tube. If, however, the bond between the tube sheet and the tube coating is broken even once at these locations, the protective effect of the coating is increasingly affected.

Measures of the type just described are known, for example, from GB-A-1 175 157, DE-U-1 939 665, DE-U-7 702 562, and EP-A-O236 388.

SUMMARY OF THE INVENTION

Considering the previously described problems, the task of the invention is based on providing the tube sheet (which, as indicated above may also be referred to herein as a "tubesheet" or "tube bed") and the coolant tube inlets and outlets adjacent to the tube sheet an integrated coating for both, which coating offers long-term resistance to the mechanical stresses at the transition points and which at the same time is suitable for resisting chemical stresses resulting from the coolant.

This task is solved using a coating of the type described at the beginning, in which the coolant tubing (or cooling tube) coating is affixed reactively to the tube sheet coating by timed application and in which the coolant tube coating exhibits in comparison to the tube sheet coating a greater elasticity having an elongation at break at least 2% greater in accordance with ASTM Standard D522, "Standard Test Methods for Mandrel Test of Attached Organic Coatings" (November 1993, believed to be identified as D522-93-A) with respect to the elongation at break (or elongation at tear) of the tube sheet coating.

Timing the coating processes on the tube sheet and in the coolant tubes allows cross linking between the coating edges of the coating in the tubes and the tube sheet coating to occur, so that there is a chemical bond especially capable of bearing. At the same time and additionally, the relatively greater elasticity of the coolant tubing coating effects better resistance to mechanical stress in the inlet and outlet areas of the tube at those locations that experience galvanic corrosion. It has been demonstrated that an increase of 2% in the elongation at tear in accordance with ASTM Standard D522 (or "ASTM D552") is in general sufficient to effect the improvement in the coating bond, an elongation at tear in the tube sheet coating of less than 5% and in the coolant tube coating of less than 10% being assumed, in order to provide the hardness, resistance to abrasion, and compressive resistance necessary for the durability of the coating. On the other hand, for the tube sheet coating, elongation at tear should not fall below 2% in order to avoid brittleness. Materials having elongation at tear in accordance with ASTM D522 of 2 to 4% have proved particularly suitable for the tube sheet, and 4 to 9% for the coolant tubes. Of particular advantage are coatings having elongations at tear of more than 3% for the tube sheet and more than 5% for the coolant tubes.

In order to apply the layers of coating necessary for lasting operation over several years and at the same time to ensure quality relative to adhesion and freedom from pore and hairline tears, it is useful to apply the coating in accordance with the invention in multiple layers, each layer being applied to the still-reactive surface of the layer underneath, in order to achieve chemical cross linkage. For purposes of utility, two or three layers are applied both to the tube sheet and to the coolant tubes; these may be differently colored in order to allow coloration to be used to inspect remaining thickness of the coating from time to time. The minimum layer thickness of the entire coating for the interior coat of the tubes is at least about 80 $\mu$m and for the tube sheet is at least 2000 $\mu$m. Layer thicknesses of 20 mm and more are easily possible without suffering losses in fastness. This is a particular advantage when working with coating tube sheets that are already heavily corroded and that exhibit deep scars from corrosion.

It has proved to be very useful to provide the cleaned surfaces of the tube sheet and the coolant tubes with a primer prior to applying the actual coating; the primer is generally sprayed on in a less viscous state and penetrates into the cavities and scars caused by corrosion. This accomplishes a leveling of the surfaces, better reduction of irregularities, and overall better adhesion of the actual coating. Likewise, the actual coating can be provided on the surface together with a sealant, especially in order to achieve a smoother surface that prevents adhesion of algae, contaminants, etc. The sealant in the area of the tube sheet is preferably adjusted to be more elastic than the tube sheet coating, and the sealant should adhere to the previously-mentioned values for elongation at tear exhibited for the coolant tube coating. In general it is useful to provide two layers of both primer and sealant. Sealing the tube area is generally not necessary.

Preferred materials for the coating in accordance with the invention are cold-setting epoxies that are distributed with an amine hardener. These resinous compounds contain conventional fillers and dyes, set-up agents, stabilizers, and other common additions in order to ensure desired characteristics, especially processibility and durability. These are conventional plastic mixtures, as they can be used for other purposes as well—for the coating in accordance with the invention, the type of hardening plastic is much less important than its resistance to corrosion and its elasticity after hardening. Besides epoxies, other cold-setting plastics that meet these requirements may also be employed. Epoxy/amine systems, however, are preferred for the purposes of the invention.

The plastic mixtures used for the tube sheet and especially for the coolant tubes contain for purposes of functionality some powder-form polytetrafluor ethylene (PTFE) in the amount of at least about 5% by weight in order to achieve the desired values of elasticity and fastness. It has been demonstrated that an addition of PTFE in the range of 5 to 20% by weight, especially about 10% by weight, significantly improves the durability of the coating in the area of the tube inlets and outlets. The PTFE addition, for example, Hostaflon (r) from Hoechst, should have a grain of <50 $\mu$m and in particular in the range of 0 to 30 $\mu$m. It forms a matrix that fills, stabilizes, and effects an improvement in elasticity, and in particular also serves to adjust the desired elasticity.

A content of >30% by weight mineral additions in the mixture is useful to increase resistivity, especially of the tube sheet coating.

In order to further improve the durability of the coating in accordance with the invention in the area of the transition from the coolant tube to the tube sheet, it can also be useful to add a plastic sheath to the coating in the area of the transition to the tube sheet, which sheath brings about an additional stabilizing effect.

It has been demonstrated that the coatings in accordance with the invention must meet certain criteria with respect to mechanical stressability. The hardness finally achieved in the coating should reach a value of at least about 75 in accordance with DIN 53153 (Barcol hardness), preferably at least 80. A value of at least 95 is useful for the tube sheet coating.

In addition, the adhesive strength of the coating on the base should be at least about 4 N/mm$^2$ in accordance with DIN Iso 4624, preferably at least about 5 N/mm$^2$, and in particular at least 7 N/mm$^2$. In accordance with the invention, adhesive strengths of more than 10 N/mm$^2$ for the tube sheet coating and more than 5 N/mm$^2$ for the coolant tube coating and primer are achieved.

Compressive strength and resistance to abrasion are essential for the stability of the invented coatings. With regard to compressive strength, values of more than 50 N/mm$^2$ for the coolant tube coating and more than 100 N/mm$^2$ for the tube sheet coating should be achieved; for resistance to abrasion according to DIN 53233 (Case A) the values should be more than 40 mg and more than 55 mg, respectively.

The invention is furthermore a process for applying the previously described coating, in which initially the surfaces provided for coating are cleaned using an abrasive, the tube inlets and outlets are closed by removable plugs, at least one layer of a hardening plastic coating is applied to the tube sheet, the coating is allowed to harden, so that additional mechanical processing can follow, but still-reactive locations on the surface remain, after which the surface is mechanically processed. Then the tube plugs are removed from the tube inlets and outlets and at least one layer of a hardening plastic coating is applied to the entrance area of the coolant tube forming a reactive bond with the tube sheet coating, the plastic mixture being selected in such a manner that the coolant tube coating exhibits in comparison to the tube sheet coating a greater elasticity having an elongation at tear at least 2% greater in accordance with ASTM D522 with respect to the elongation at tear of the tube sheet coating.

In an alternative embodiment of the process, only the tube inlets are closed by removable plugs. In this embodiment, the process for applying the previously-described coating is conducted by initially cleaning the surfaces provided for coating using an abrasive, closing the tube inlets by removable plugs, applying at least one layer of a hardening plastic coating to the tube sheet, allowing the coating to harden, so that additional mechanical processing can follow, but still-reactive locations on the surface remain, after which the surface is mechanically processed. Then the tube plugs are removed from the tube inlets and at least one layer of a hardening plastic coating is applied to the entrance area of the coolant tube forming a reactive bond with the tube sheet coating, the plastic mixture being selected in such a manner that the coolant tube coating exhibits in comparison to the tube sheet coating a greater elasticity having an elongation at tear at least 2% greater in accordance with ASTM D522 with respect to the elongation at tear of the tube sheet coating.

It is important for any of the processes in accordance with the invention that the surfaces provided for coating are thoroughly abrasively cleaned in order to create a fixed and uniform base. There are two reasons for closing the tubing inlets and outlets (or the tubing inlets only in the alternative embodiment) with removable plugs, which in and of itself is known. First, penetration by the mass provided for coating the tube sheet into the tube inlets is to be prevented; second, the tube sheet coating is to be adjusted to the course of the coolant tube and corresponding contouring is undertaken, to which appropriately shaped plugs are related. In this way in particular the tube inlet is formed in a manner favorable for flow and a section for joining the coolant tube coating to the tube sheet coating is easily provided. It can make sense, especially for older tube sheets, to mold the coolant tube at the inlet and outlet as needed in order to ensure a smooth transition to the embedding of the tubing inlets in the tube sheet coating (DE-U-7 702 562). This achieves in particular that the tube sheet/coolant tube transition does not coincide with the coating for the tube sheet/coolant tube coating, which increases the life expectancy of the coating.

Cleaning the surfaces to be coated is preferably done by blasting using an abrasive, for example, sandblasting. In the next step, the tube inlets are closed with the plugs provided for this use. In the embodiment wherein the tube inlets and outlets are closed with the plugs, both the tube inlets and the tube outlets are closed with the plugs provided for this use. Then, preferably, a primer is applied, especially a primer having a coating mass that achieves the elasticity characteristics of the coating provided for the coolant tube. Since it is useful to apply the primer in a spraying process, the appropriate plastic mixtures should exhibit appropriate viscosity, also with respect to the ability to penetrate the corrosion scars in the metal surface. The thickness of the layer should be at least about 80 $\mu$m. Drying time for epoxy is about 8 hours to a few days at 20° C., it being ensured in this period that a still-reactive bond for the subsequent layer can be formed. A roller process may also be selected for application, however.

One to three layers of the plastic mass provided for the tube sheet are applied over the primer, especially by spatula, in order to ensure penetration into cavities, to eliminate hollow spaces, and to avoid formation of pores and bubbles. For this it has proved useful to apply multiple layers to achieve the necessary layer thicknesses of 20 mm or more. Drying time until further processing is about 24 hours up to 4 days for epoxy. After hardening, the surface is mechanically polished, especially by processing using an abrasive. The polishing process is useful because it achieves a uniform surface that provides less resistance to the coolant appearing on the tube sheet and offers fewer locations for mechanical erosive corrosion and accumulations of, for example, algae. During application it should be ensured that the individual layers are reactively bonded to each other.

It is useful to apply a sealant, generally in two coats, over the coating that has been applied by spatula. A plastic mixture having its elasticity adjusted based on the underlying coating serves as the material for this, for example, a mixture such as that described for coating the coolant tubes. The thickness of each individual layer should be at least 40 $\mu$m, a total of at least about 80 $\mu$m, drying times for epoxy/amine systems are 6 hours to the point when they are no longer tacky. The sealant, especially if sprayed or rolled on, by blending with the plastic mass, achieves further polishing of the surface, so that the surface offers fewer locations for corrosion damage and accumulations to take hold. It is useful not to apply the sealant until the coolant tubes are being coated, at least the last layer of coating applied to the coolant tubes being extended seamlessly onto the coating for the tube sheet.

The entire coating can be mechanically and chemically stressed after about 7 days at a hardening temperature of 20° C.

After the tube sheet coating is applied to the primer and mechanical reprocessing has occurred, in the next step the plugs are removed from the tubing inlets. In the embodiment wherein the tube inlets and outlets are closed with the plugs, the plugs are removed from the tube (or tubing) inlets and outlets. Then the coolant tube coating is applied on the cleaned surface in the tubing, at least in its inlet area, but preferably along its entire path, preferably in multiple layers. Spraying has proved to be especially suitable for application, beginning with a jet suitable for this and spraying sideways at the end turned away from the tube sheet and coating down to the tube sheet. Alternatively, the coating may also be rolled on using a brush saturated with the coating material, the brush rotating and the coating material being thrown against the walls of the tube. The plastic mixtures used for this are adjusted to spraying viscosity, attention being paid both to the greatest possible ability to penetrate and to immediate adhesion without formation of drips. It is also useful to apply multiple layers, initially a primer in one or two layers on the metal surface, which for epoxies hardens in 8 hours to 8 days, and then the actual coating in one or more layers, with a hardening time of 6 hours to 4 days. Subsequent processing for the coolant tube coating is not necessarily required. As described above, at least the last layer of the tube coating is applied to the tube sheet coating in one stroke, where it serves as a sealant.

The individual layers of the tube coating and sealant are applied in a thickness of at least about 40 $\mu$m; the entire dry coating thickness for lasting corrosion protection should be at least about 80 $\mu$m. In applying multiple layers it is important to pay attention to time; both the transition to the coating of the tube sheet coating and the individual layers of the coolant tube coating must be applied within a time period that allows development of chemical cross linking with the underlying layer.

The coolant tube coating can also be chemically and mechanically stressed after about 7 days. The times given refer to epoxy/amine systems and 20° C.

The coating in the coolant tubes, if it is not continuous, should taper off layer by layer, so that there is a gradual flattening. It is useful to go into and up the bare metal of the coolant tube with each successive outer layer, so that the underlying layer is completely covered by the layer on top of it. Each outer layer may also begin farther to the outside than the underlying layer, however.

It is useful for all coatings to color the individual layers differently in order to be able to control the coating and its thickness. By simply using a gray primer and alternating red and white layers for the total coating on top, it is possible to control the remaining layer thickness using the coloration and, for example, to determine when the next-to-the-last and the last layers have been reached. In this manner it is possible to fully exploit the life expectancy of the coating and to conduct specific repairs at locations particularly affected by corrosion or erosion, these distinguishing themselves from their surroundings by their differing coloration.

BRIEF DESCRIPTION OF THE DRAWINGS

The invention is explained in more detail using the following illustrations. These show.

DETAILED DESCRIPTION

Figure 1C:
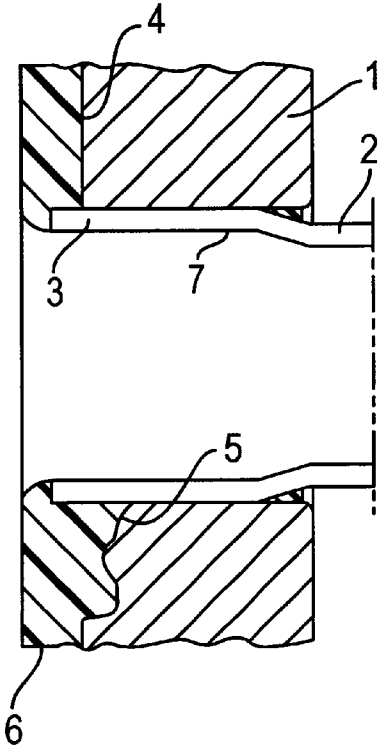
FIGS. 1(*a*)–1(*c*)—in cross-section, the condition, not corroded and corroded, of a tube sheet having a coolant tube inlet, each having coatings, in three variants, 1(*a*) through 1(*c*)
Figure 1B:
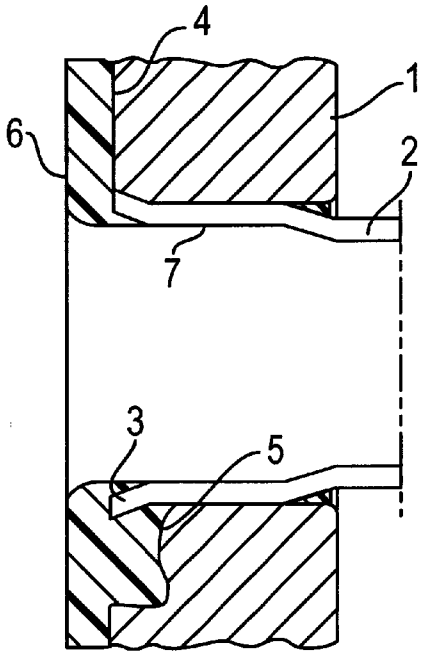
Figure 1A:
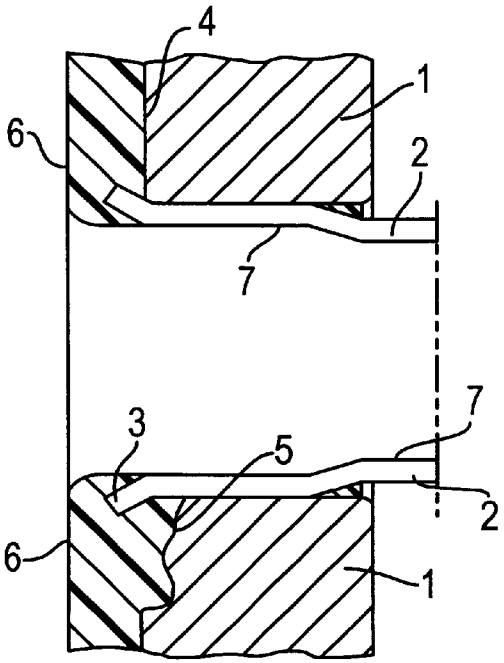

FIG. 1(*a*) illustrates in cross-section a tube sheet 1 having a coolant tube 2. The projecting end of the tube 3 in the area of the coolant tube inlet is bent or pressed to the sides. In the top half of the illustration (also in FIGS. 1(*b*) and (*c*)), the tube sheet exhibits an intact polished surface 4, as it practically only occurs in new condition, given no particular protection. In the lower half of the illustration, the surface of the tube sheet is significantly damaged by the effects of corrosion, especially in the area of the coolant tube entrance, deep corrosion scars having developed by galvanic corrosion.

The darkened parts in the area of the tube sheet surface 4 represent a coating 6 having a cold-setting plastic mixture suitable for it. The coating 6 passes over into the coolant tube coating. The corrosion scar 5 is completely filled by the coating. Since the coating mass itself is practically chemically inert, the tube sheet 1 and the tube 2 are completely protected from the damaging cooling water. This essentially eliminates galvanic corrosion.

FIGS. 1(*b*) and (*c*) show common variants of the coolant tube extension with flush end (1*b*) and with projecting end not pressed outward (1*c*), in each case (1*a* through 1*c*) the tube end 3 being completely integrated in the coating 6, 7.

Figure 2:
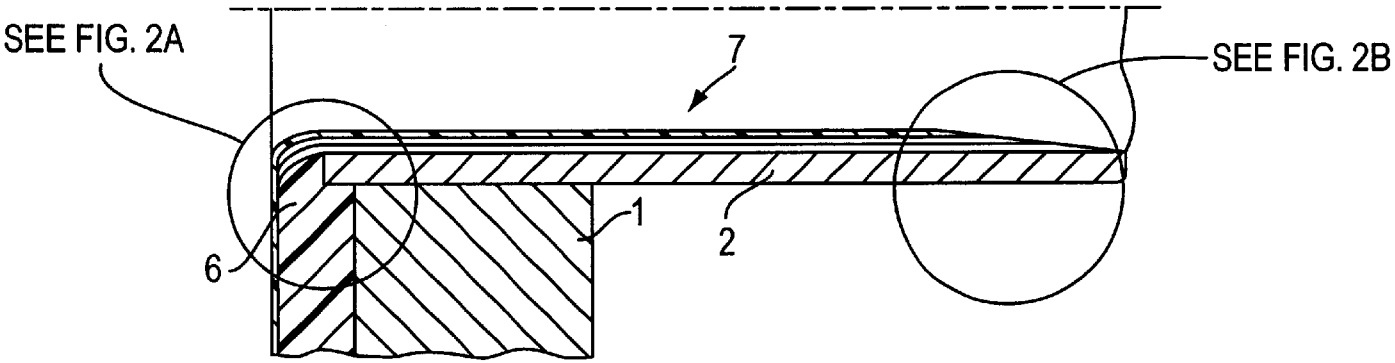
FIGS. 2, 2A, 2B—the coating in accordance with the invention of a tube sheet and an entering coolant tube in its layered construction.
Figure 2B:
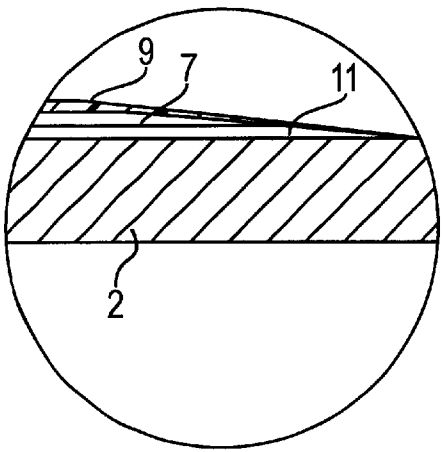
Figure 2A:
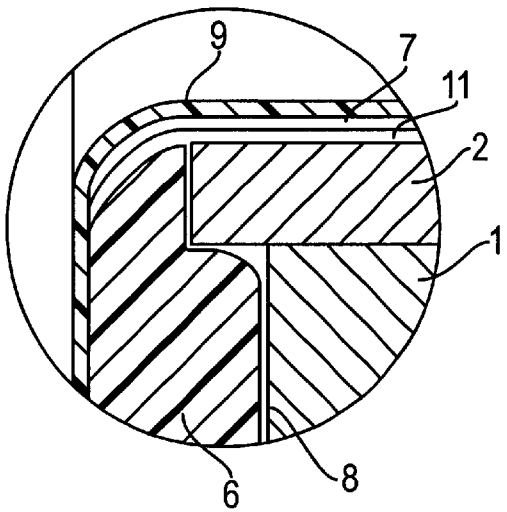

FIG. 2 shows the layered construction of the coating in accordance with the invention. Details of the tube sheet coating and the tube coating are shown in sections A and B (FIGS. 2A and 2B).

The tube sheet 1 itself exhibits a primer 8 underneath the actual coating 6, the primer filling in smaller irregularities. The polished surface of the coating 6 is initially protected by a sealant 9 that runs into the tube and forms the exterior layer in the tube coating.

The wall 2 of the coolant tube is initially provided with a primer 11 on the cleaned metal surface. The actual coolant tube coating 7, adjusted elastically with respect to the coating for the tube sheet, is applied to this base 11. In the case illustrated, the coolant tube 2 is not coated over its entire length, but rather only in the entry area, the coating running out conically in its entirety (Section B), e.g., each of the layers projecting farther into the tube than the layer beneath it. The final layer in the coolant tube coating 9 is also the sealant 9 for the tube sheet coating 6. The bent outlet of the tube coating (11, 7, 9) represented in cut A is given by the contour of the plugs provided during coating of the tube sheet, which is removed prior to coating the coolant tube.

The total thickness of all layers in the area of the tube sheet is >2000 $\mu$m and in the area of the tube sides is >80 $\mu$m; thicker layers can be easily achieved.

Epoxies that are processed with an amine as hardener have proved to be particularly suitable for the coatings in accordance with the invention. These are common systems that can be adjusted without using a solvent. Suitable products, for example, are epoxies based on glyidyleters and bis-phenol A derived epoxies that are hardened with a common modified polyamine. The epoxy and hardening components contain common additions that control processibility, chemical and storage stability, and resistivity.

What is claimed is:

1. A heat exchanger comprising a tube sheet and heat exchanger coolant tubes extending from the tube sheet, the tube sheet and the coolant tubes comprising a coating based on hardening plastic mixtures, the coating obtained by a method comprising:

cleaning surfaces provided for the coating using an abrasive; closing coolant tubes inlets with removable plugs; applying at least one layer of a hardening plastic mixture on the tube sheet to form a coating of the tube sheet; allowing the coating of the tube sheet to harden so that additional mechanical processing can ensue, and processing the coated surface of the tube sheet; removing the removable plugs from the coolant tubes inlets; applying at least one layer of a hardening plastic mixture at least in the inlet area of the coolant tubes to form a coating of the coolant tubes, and allowing it to harden; providing that coating of the coolant tubes is being carried out so that the coating of the coolant tubes is bonded chemically to the coating of the tube sheet, and the coating of the coolant tubes in comparison to the coating of the tube sheet exhibits greater elasticity having at least 2% greater elongation at break relative to the elongation at break of the coating of the tube sheet.

2. A heat exchanger in accordance with claim 1, wherein an elongation at break for the coating of the tube sheet is 2 to 4% and an elongation at break for the coating of the coolant tubes is 4 to 9%.

3. A heat exchanger in accordance with claim 1 or 2, wherein an elongation at break in the coating of the tube sheet is at least 3% and an elongation at break in the coating of the coolant tubes is at least 5%.

4. A heat exchanger in accordance with claim 1 or 2, wherein the coating comprises multiple individual layers, each of which is applied to the still-reactive surface of the preceding layer.

5. A heat exchanger in accordance with claim 4, wherein the individual layers exhibit different coloring.

6. A heat exchanger in accordance with claim 1 or 2, wherein the coating of the coolant tubes has thickness of at least 80 $\mu$m and the coating of the tube sheet has thickness of at least 2000 $\mu$m.

7. A heat exchanger in accordance with claim 1 or 2, wherein the coating is based on an epoxy/amine hardener system.

8. A heat exchanger in accordance with claim 1 or 2, wherein the plastic mixtures contain fillers and dyes, set-up agents, stabilizers, and other common additions.

9. A heat exchanger in accordance with claim 1 or 2, wherein the hardening plastic mixture applied on the coolant tubes contains 5 to 20% by weight of powder-form polytetrafluor ethylene, having a grain of <50 $\mu$m.

10. A heat exchanger in accordance with claim 1 or 2, wherein the coating is applied on top of a primer and/or includes a sealant.

11. A heat exchanger in accordance with claim 10, wherein the sealant is a plastic layer having at least 2% greater elongation at break relative to the elongation at break of the coating of the tube sheet.

12. A heat exchanger in accordance with claim 1, wherein an elongation at break for the coating of the tube sheet is at least 2%.

13. A heat exchanger comprising a tube sheet and heat exchanger coolant tubes extending from the tube sheet, the tube sheet and the coolant tubes comprising a coating based on hardening plastic mixtures, the coating comprising:

at least one layer of a hardening plastic mixture on the tube sheet forming a coating of the tube sheet; at least one layer of a hardening plastic mixture at least in the inlet area of the coolant tubes forming a coating of the coolant tubes; the coating of the coolant tubes being bonded chemically to the coating of the tube sheet, and the coating of the coolant tubes in comparison to the coating of the tube sheet exhibiting greater elasticity having at least 2% greater elongation at break relative to the elongation at break of the coating of the tube sheet.

* * * * *